US010605055B2

(12) United States Patent
Saini et al.

(10) Patent No.: US 10,605,055 B2
(45) Date of Patent: Mar. 31, 2020

(54) INTEGRATED HYDROCARBON FLUID DISTRIBUTION MODELING

(71) Applicants: Prem Dayal Saini, Voorburg (NL); Petrus M. E. van Hooff, IJmuiden (NL); Hendrik Eikmans, Assen (NL)

(72) Inventors: Prem Dayal Saini, Voorburg (NL); Petrus M. E. van Hooff, IJmuiden (NL); Hendrik Eikmans, Assen (NL)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 393 days.

(21) Appl. No.: 15/266,687

(22) Filed: Sep. 15, 2016

(65) Prior Publication Data

US 2018/0073332 A1 Mar. 15, 2018

(51) Int. Cl.
*E21B 43/00* (2006.01)

(52) U.S. Cl.
CPC ..... *E21B 43/00* (2013.01)

(58) Field of Classification Search
None
See application file for complete search history.

(56) References Cited

U.S. PATENT DOCUMENTS

2010/0155142 A1 6/2010 Thambynayagam et al.
2010/0198638 A1 8/2010 Deffenbaugh et al.
2010/0217563 A1* 8/2010 Montaron et al. ..... G06G 7/50 703/10
2011/0054857 A1* 3/2011 Moguchaya ..... G01V 99/00 703/2
2011/0088895 A1* 4/2011 Pop ..... E21B 7/04 166/254.2
2013/0140037 A1 6/2013 Sequeira et al.
2013/0338984 A1* 12/2013 Braaksma et al. ..... G01V 1/34 703/10
2013/0338987 A1* 12/2013 Cheng et al. ..... G06F 17/50 703/10

(Continued)

FOREIGN PATENT DOCUMENTS

WO 0123829 A2 4/2001
WO 2007140264 A2 12/2007

OTHER PUBLICATIONS

G. M. Grammer et al.,"Integration of Outcrop and Modern Analogs in Reservoir Modeling: Overview with Examples from the Bahamas", AAPG Memoir 80, 2004, pp. 1-22.

(Continued)

*Primary Examiner* — Bijan Mapar
(74) *Attorney, Agent, or Firm* — Cantor Colburn LLP

(57) ABSTRACT

Examples of techniques for integrated hydrocarbon fluid distribution modeling are disclosed. In one example implementation according to aspects of the present disclosure, a computer-implemented method may include: generating, by a processing device, a structural model of a hydrocarbon reservoir; generating, by the processing device, a fluid distribution model based on the structural model and well data; responsive to receiving updated well data, updating, by the processing device, the fluid distribution model iteratively; determining, by the processing device, a trajectory to drill the hydrocarbon reservoir based on the fluid distribution model; and drilling a well into the hydrocarbon reservoir based on the trajectory.

10 Claims, 6 Drawing Sheets

(56) References Cited

U.S. PATENT DOCUMENTS

2015/0247942 A1* 9/2015 Pomerantz ..... G01V 1/003
702/11

OTHER PUBLICATIONS

Notification of Transmittal of the International Search Report and the Written Opinion of the International Searching Authority, or the Declaration; PCT/US2017/051129; dated Dec. 26, 2017; 16 pages.

* cited by examiner

400

INTEGRATED HYDROCARBON FLUID DISTRIBUTION MODELING

BACKGROUND

The present disclosure relates generally to well operations and, more particularly, to integrated hydrocarbon fluid distribution modeling.

The business value of an asset is contained in the fluids (e.g., hydrocarbons) in the subsurface. The initial fluid distribution is key for asset valuation, for optimum development and for reserves estimates and reporting. Fluid distribution is governed by the geological structure, charge history, reservoir properties, and fluid properties, among others. The underlying data and their relations cross boundaries between subsurface disciplines such as geology, petrophysics, and reservoir engineering.

The fluid distribution can be complex, especially for structurally complex fields, and can often carry a large uncertainty, which directly affects value estimates. As mentioned, the data required to define a consistent subsurface fluid distribution model is scattered across different tools and disciplines of geology, petrophysics and reservoir engineering. In many cases the individual data elements are not conclusive. For instance, the presence of flow barriers can lead to complex fluid distributions with fluid levels occurring at different depths. However in many cases it is not possible for a geologist to predict with high degree of confidence whether or not a geological surface acts a flow barrier. When integrating the available data from different sources, a consistent description of the fluid distribution can be formulated, which can be challenging.

BRIEF SUMMARY

According to examples of the present disclosure, techniques including methods, systems, and/or computer program products for integrated hydrocarbon fluid distribution modeling are provided. An example computer-implemented method may include: generating, by a processing device, a structural model of a hydrocarbon reservoir; generating, by the processing device, a fluid distribution model based on the structural model and well data; responsive to receiving updated well data, updating, by the processing device, the fluid distribution model iteratively; determining, by the processing device, a trajectory to drill the hydrocarbon reservoir based on the fluid distribution model; and drilling a well into the hydrocarbon reservoir based on the trajectory.

Additional features and advantages are realized through the techniques of the present disclosure. Other aspects are described in detail herein and are considered a part of the disclosure. For a better understanding of the present disclosure with the advantages and the features, refer to the following description and to the drawings.

BRIEF DESCRIPTION OF THE DRAWINGS

The subject matter which is regarded as the invention is particularly pointed out and distinctly claimed in the claims at the conclusion of the specification. The foregoing and other features, and advantages thereof, are apparent from the following detailed description taken in conjunction with the accompanying drawings in which:

DETAILED DESCRIPTION

Figure 1:
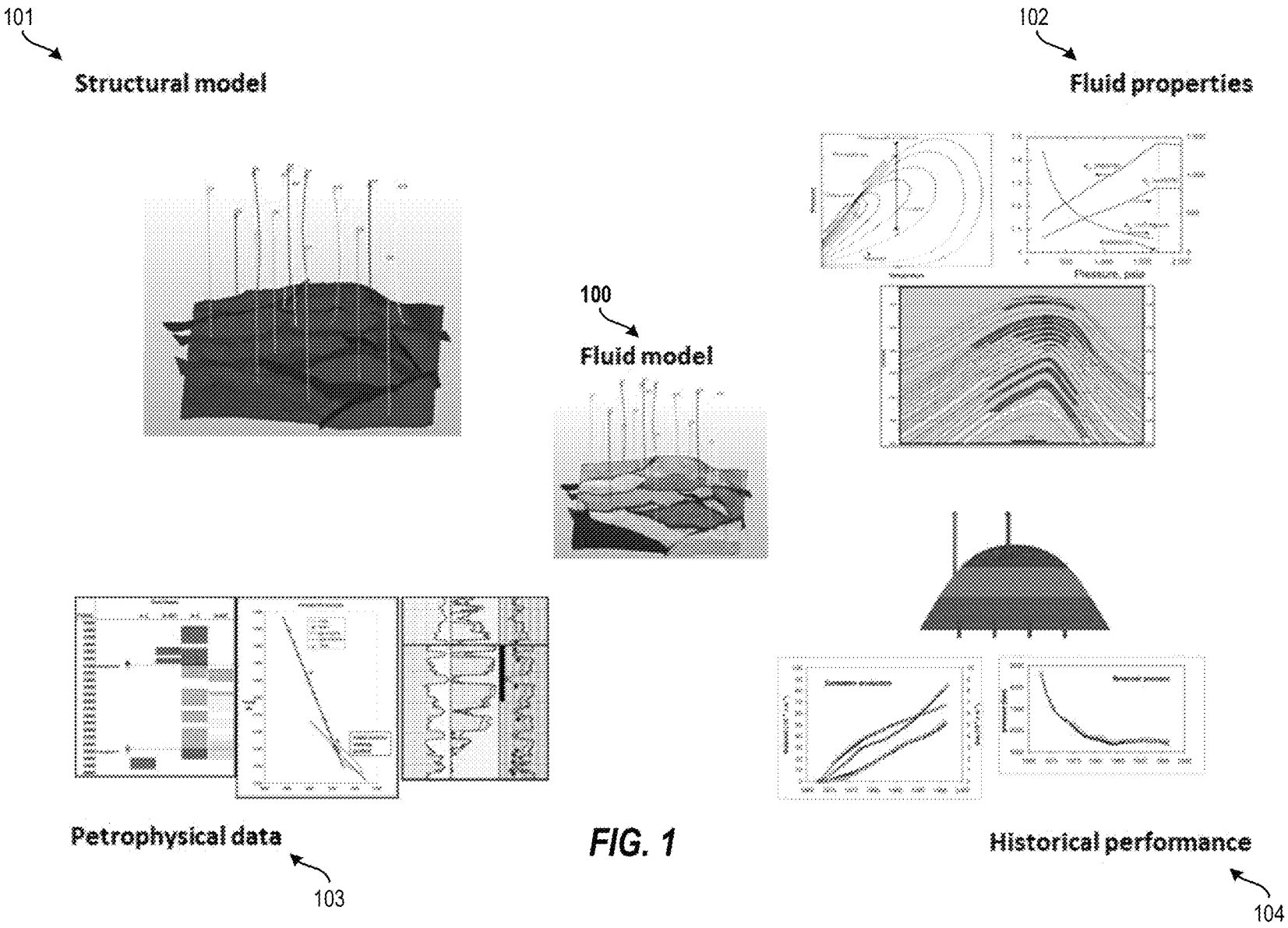
FIG. 1 illustrates a block diagram of component elements used to generate an integrated hydrocarbon fluid distribution model according to aspects of the present disclosure.

Existing subsurface modeling approaches, such as software provided by Schlumberger's Petrel, enables a user to define subsurface fluid distribution. However, these existing approaches provide no dedicated workflow with algorithms and visualizations to assist the user with creating a description of a fluid distribution that is consistent with all relevant data, such as data received from multiple disciplines. Although some existing approaches provide a workflow to define part of the subsurface fluid distribution, they do not however provide 3D modeling for the subsurface. In these workflows, it is difficult for a user to understand where the various wellbores are positioned in relation with the 3D geological description. In order for the user to achieve workflow disclosed herein using existing approaches, a user would have to manually analyze and consolidate data distributed across the different disciplines of geology, petrophysics, reservoir engineering, etc., by using external tools (i.e., software). In addition, using existing approaches, the user has to perform certain calculations manually in calculators and 3D grids. The fluid distribution model allows the data from well bores, such as fluid logs, pressure data, and saturation data, to be integrated with the structural model. This is made possible by an algorithm to calculate the intersection of the well bores with fluid compartments.

The fluid modeling workflow of the present disclosure enables a user to define the initial fluid distribution in the form of three-dimensional (3D) compartments and fluid levels in an iterative process. The outcome of the workflow is a consistent, integrated fluid description for subsequent usage in volumetrics and dynamic simulation.

The present subsurface fluid modeling workflow provides a means to store and analyze related data and to produce multiple scenarios of initial fluid distribution. The present fluid model allows multiple disciplines to combine data in a central, integrated workflow. For instance, the fluid model workflow checks the assumptions by the geologist regarding presence of flow barriers against the fluid log data from the petrophysicist. In the fluid model workflow this is done by an algorithm that automatically calculates any inconsistencies and highlights the inconsistencies in dedicated visualizations and warning messages. In this way, the workflow reduces the risk of inconsistent fluid distribution descriptions by different disciplines.

The present subsurface fluid modeling workflow also considers the difference in volumes from static modeling tools versus dynamic simulations. There are different assumptions and workflows between static modeling tools and dynamic simulation. Reconciliation of the initial fluids in-place is generally time-consuming. Errors can also lead to unphysical fluid distribution models, which can result in unphysical fluid movements in the reservoir simulation model prior to any reservoir off take. To address these issues, the saturation functions are integrated in the fluid modeling workflow. The saturation functions are defined relative to compartment fluid levels, which are systematically distinguished from well fluid contacts. This workflow ensures that the saturations as seen on well logs are properly translated in the capillary pressure models. When applied in the reservoir simulation models by the reservoir engineer, these capillary pressure models will reproduce the correct saturations. This provides a more consistent representation of the fluid distribution with gains in accuracy (better representation) and in efficiency (less time reconciling static and dynamic models).

Example embodiments of the disclosure include or yield various technical features, technical effects, and/or improvements to technology. Example embodiments of the disclosure provide for generating a script for generating an integrated hydrocarbon fluid distribution model. The fluid distribution model described herein provides for the efficient simulation and extraction of hydrocarbons from a subsurface reservoir. These aspects of the disclosure constitute technical features that yield the technical effect of increasing production at a well operation. As a result of these technical features and technical effects, generating the fluid distribution model in accordance with example embodiments of the disclosure represents an improvement to existing hydrocarbon well modeling and simulation techniques. It should be appreciated that the above examples of technical features, technical effects, and improvements to technology of example embodiments of the disclosure are merely illustrative and not exhaustive.

FIG. 1 illustrates a block diagram of component elements used to generate an integrated hydrocarbon fluid distribution model 100 according to aspects of the present disclosure. The component elements may include a structural model 101, fluid properties 102, petrophysical data 103, and/or historical performance data 104.

The structural model 101 may be provided by geologists and comprises fluid compartments that may contain hydrocarbons. The fluid properties 102 may provide pressure, volume, and temperature information for the hydrocarbons. The petrophysical data 103 includes saturation and initial pressure information. The historical performance data 104 provides production and pressure depletion information The component elements may become available at different times. For example, the structural model 101 may be available before the other component elements. The present techniques enable a fluid distribution model 100 to be developed before all component elements are available. Once other components become available, the fluid distribution model 100 may be updated interactively to provide more accuracy.

Figure 2:
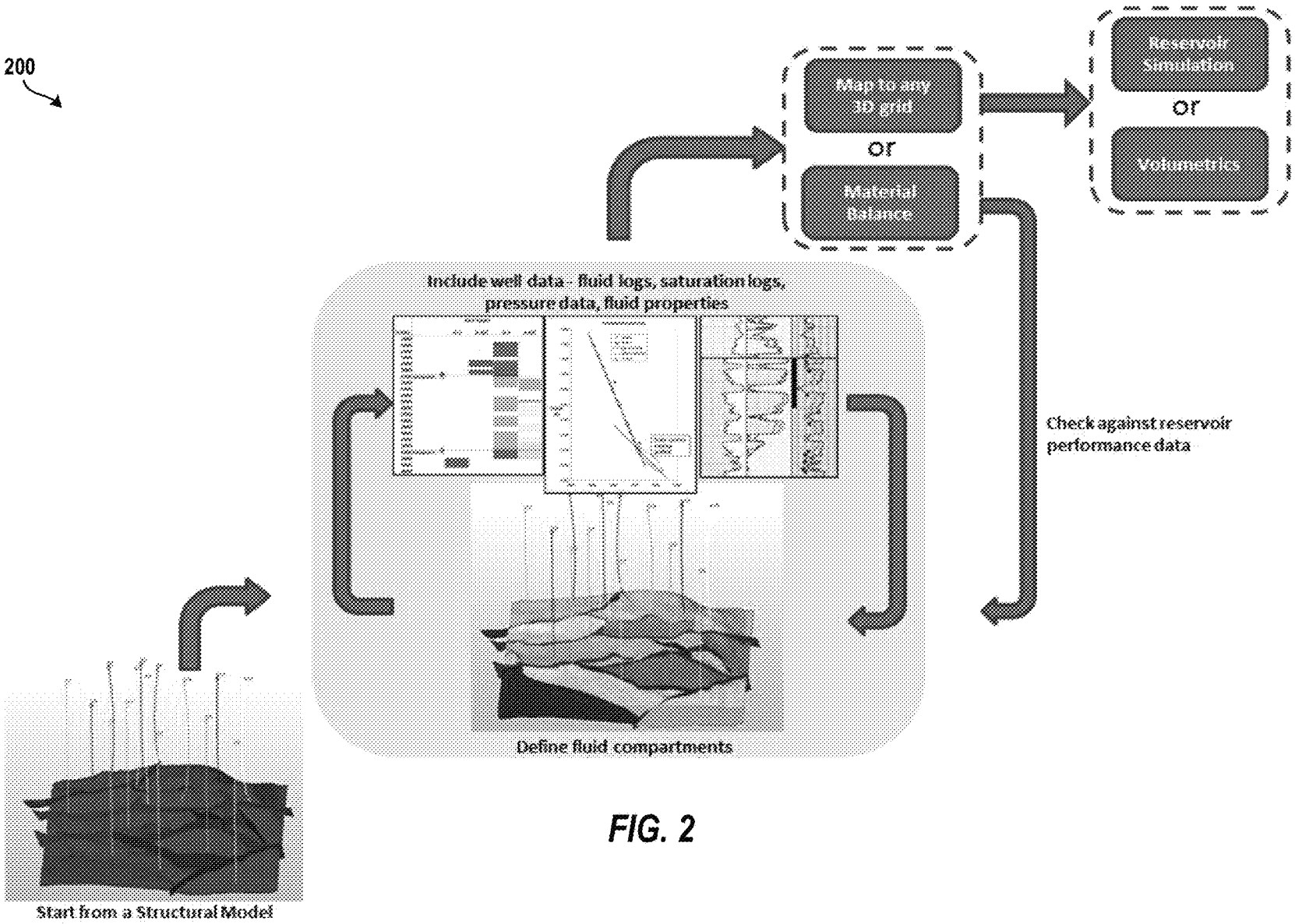
FIG. 2 illustrates a block diagram of a workflow of an integrated hydrocarbon fluid distribution model according to aspects of the present disclosure.

FIG. 2 illustrates a block diagram of a workflow 200 of an integrated hydrocarbon fluid distribution model according to aspects of the present disclosure. The workflow 200 begins with the structural model, and, as well data becomes available from different disciplines, the fluid distribution model is updated based on the well data. Examples of well data may include fluid logs, saturation logs, pressure data, and fluid properties. As the well data is added to the fluid distribution model, the definition of the fluid compartments containing the hydrocarbons is improved. It should be appreciated that the fluid distribution modeling is grid agnostic and directly links to the structural model and well data. In conventional workflows the structural model is confronted with Petrophysical fluid related data, such as fluid logs, pressure data, and saturation data, only after the time-consuming process of building a 3D grid with a full description of all rock properties. If inconsistencies are found that require the structural model to be revisited, the workflows to generate the 3D grid and the rock properties also need to be repeated. This is very time consuming especially when it involves multiple iterations. The fluid distribution model allows the geologist and petrophysicist to identify and resolve any inconsistencies before going into the workflow to build a 3D grid including the rock properties. This provides an efficient iteration process towards a fully consistent and integrated fluid distribution model.

The fluid distribution model provides the option to create a quick material balance model. In this way the fluid distribution model can be checked very quickly against reservoir performance data generated during production from a well drilled into the hydrocarbon reservoir. In conventional workflows the fluid distribution model is confronted with reservoir performance data only after the complex process of generating a 3D grid with a description of the rock properties. If any inconsistencies are identified that require the structural model to be revisited, the workflows to generate the 3D grid and the rock properties also need to be repeated. The fluid distribution model allows the geologist and the reservoir engineer to identify and resolve any inconsistencies before going into the workflow to build a 3D grid including the rock properties. This provides an efficient iteration process towards a fully consistent and integrated fluid distribution model The 3D grid may be used to perform reservoir simulations or volumetrics analytics to evaluate the reservoir of hydrocarbons and to determine drilling parameters for extracting the hydrocarbons from the reservoir. The workflow 200 is described in more detail below with reference to FIG. 5.

Figure 3:
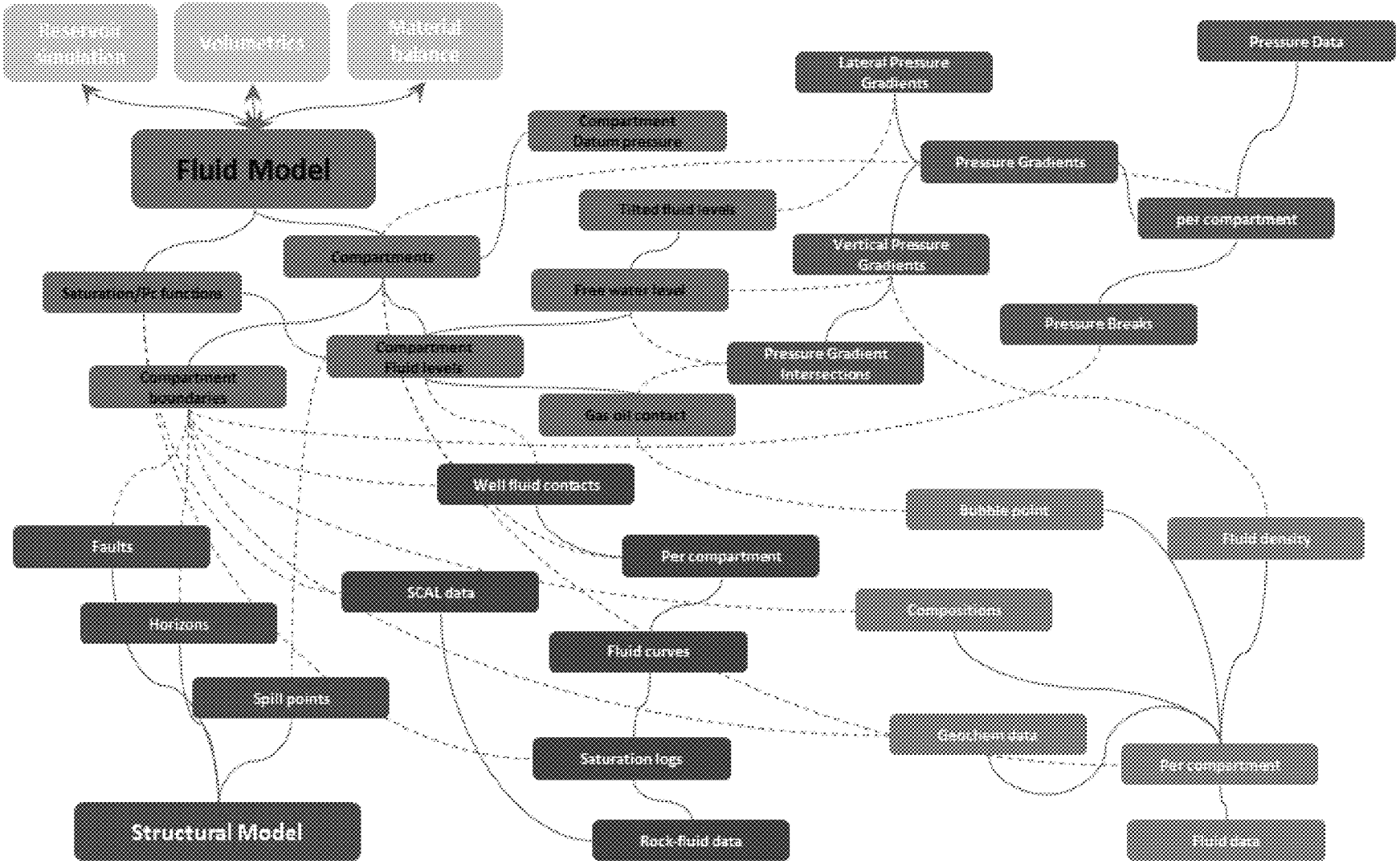
FIG. 3 illustrates a block diagram of the component elements used to generate an integrated hydrocarbon fluid distribution model according to aspects of the present disclosure.

FIG. 3 illustrates a block diagram of the component elements used to generate an integrated hydrocarbon fluid distribution model according to aspects of the present disclosure. For example, the fluid model may be derived from various data, such as a structural model, reservoir property model, rock-fluid data, fluid data, pressure data, and others, as illustrated in FIG. 3.

The various component elements may be generated by petroleum geologist, petro-physicists, reservoir engineers, geochemist, and the like. For example, a petroleum geologist and a geophysicist may provide the structural model. A petroleum geologist and a petro-physicist may provide the reservoir property model. A petro-physicist and a reservoir engineer may provide the rock-fluid data. A reservoir engineer and a geochemist may provide the fluid data. A petrophysicist and a reservoir engineer may provide the pressure data. The fluid distribution model allows this data to be integrated in a consistent model which can then be used for reservoir simulation, volumetrics, and further material balance calculations.

Figure 4:
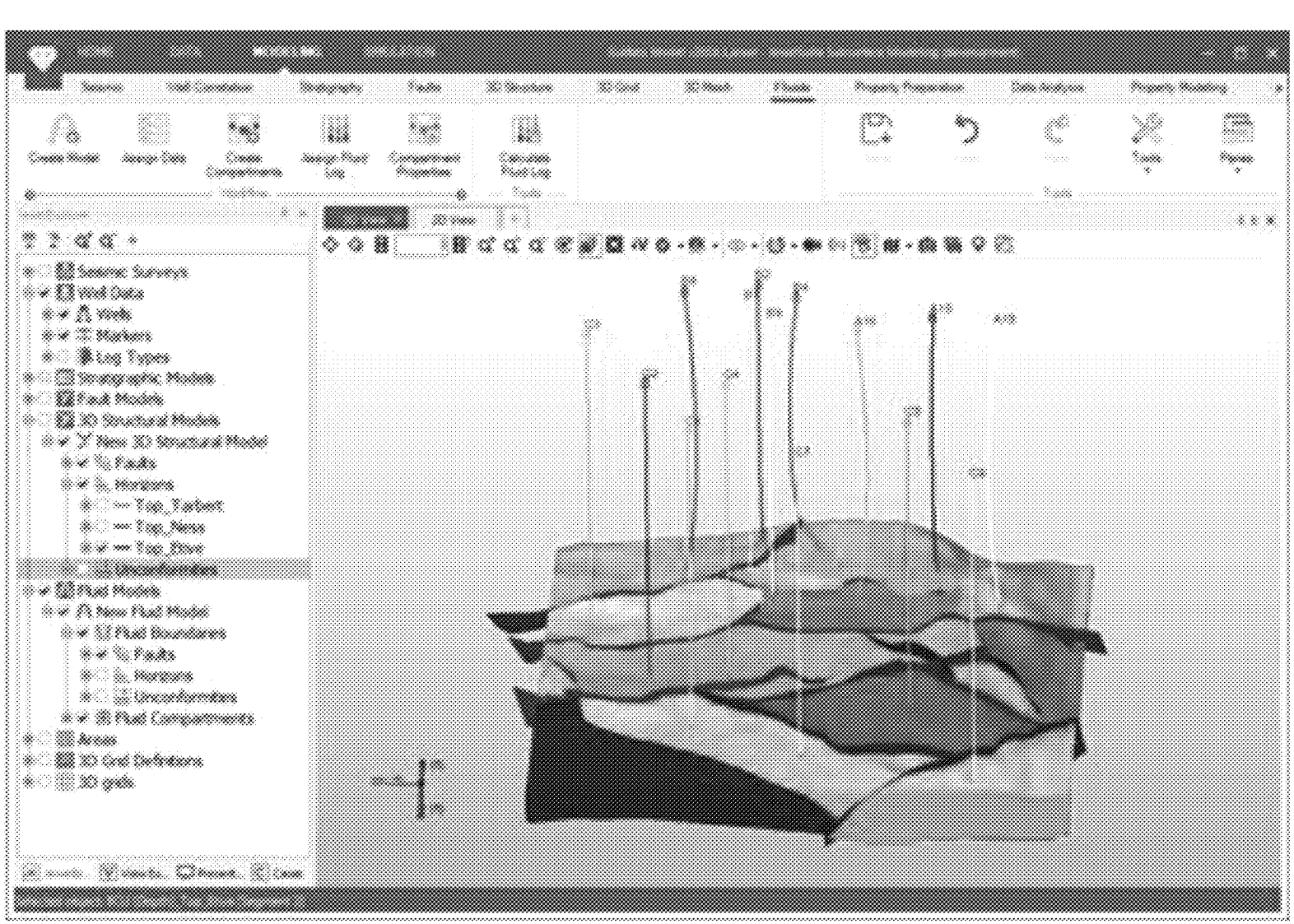
FIG. 4 illustrates a screenshot of an interface for managing a fluid model workflow according to aspects of the present disclosure.

FIG. 4 illustrates a screenshot of an interface 400 for managing a fluid model workflow according to aspects of the present disclosure. The interface 400 may be displayed on a display of a processing system such as the display 35 of the processing system 20 of FIG. 6.

In examples, the interface 400 enables a user to: define fluid compartments directly on top of the structural model; visualize fluid compartments in 3D; incorporate well fluid logs and analyze the data per compartment; automate signaling of inconsistencies between well data and compartment definition; merge and unmerge compartments to resolve inconsistencies with the well data; and propagate the fluid model seamlessly into a volumetrics workflow. It should be appreciated that the interface 400 may be configured to enable a user to perform additional tasks and to present other information as described herein.

Figure 5:
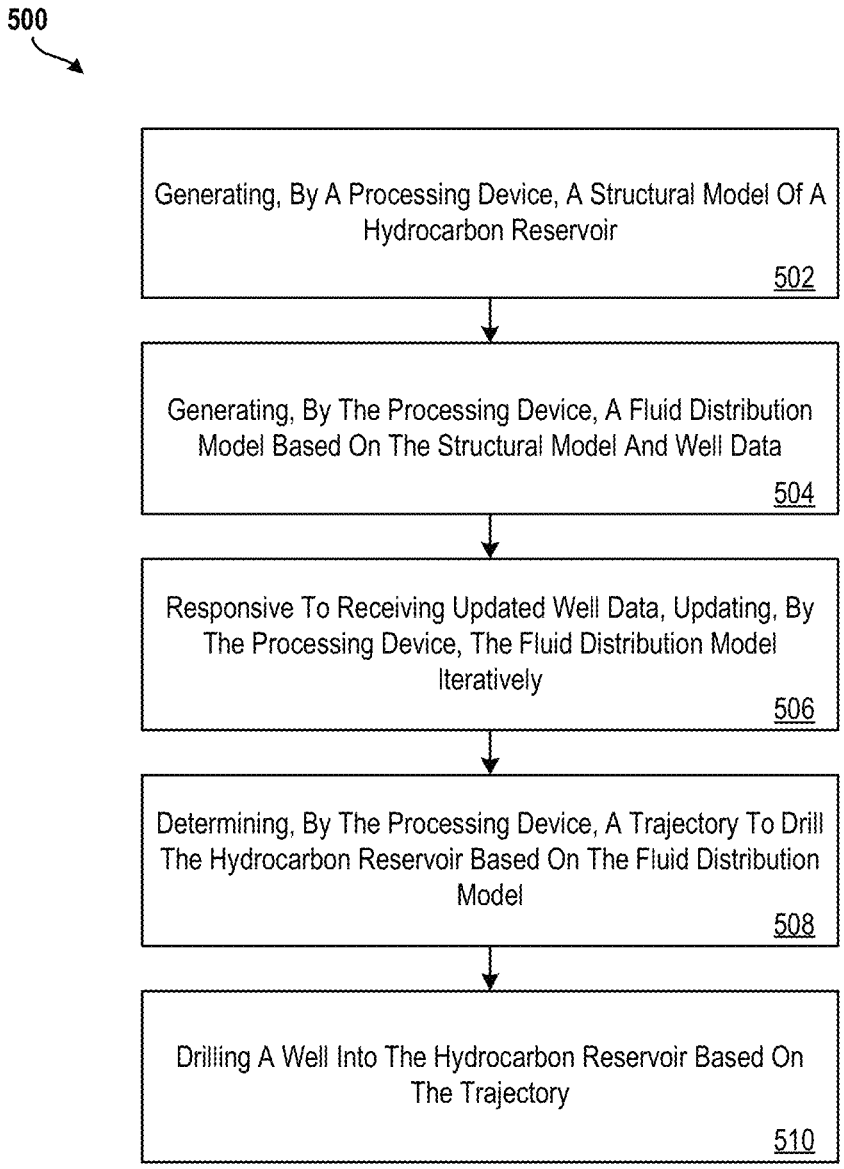
FIG. 5 illustrates a flow diagram of a method for generating an integrated hydrocarbon fluid distribution model according to aspects of the present disclosure.

FIG. 5 illustrates a flow diagram of a method 500 for generating an integrated hydrocarbon fluid distribution model according to aspects of the present disclosure. The method 500 may be performed by any suitable processing system, such as the processing system 20 of FIG. 6, or by another suitable processing system.

At block 502, the method 500 includes generating, by a processing device, a structural model of a hydrocarbon reservoir. The structural model may include a plurality of fluid compartments containing the hydrocarbons.

At block 504, the method 500 includes generating, by the processing device, a fluid distribution model based on the structural model and well data. Using the structural model as a starting point, the fluid distribution model can begin to be generated. As well data (e.g., fluid logs, saturation logs, pressure data, and fluid properties) is received, the well data is used to generate and update the fluid distribution model. The well data may be received from various sources and disciplines (e.g., geology, petrophysics, and reservoir engineering, etc.) and may be available at different times. For example, petrophysical data may be available before reservoir engineering data. In this case, the petrophysical data may be used to generate the fluid distribution model. The fluid distribution model can be updated later when the reservoir engineering data becomes available. By generating the fluid distribution model early (i.e., before all well data is available), the fluid distribution model may be used to perform reservoir simulations and/or volumetrics earlier than existing approaches.

In particular, at block 506, the method 500 includes, responsive to receiving updated well data, updating, by the processing device, the fluid distribution model iteratively. That is, as updated or previously unavailable well data becomes available, the fluid distribution model may be updated. The updating may occur iteratively each time new/updated well data becomes available. Because the fluid distribution model is updatable, the model may be refined as additional well data becomes available.

At block 508, the method 500 includes determining, by the processing device, a trajectory to drill the hydrocarbon reservoir based on the fluid distribution model. The trajectory indicates where the hydrocarbon reservoir should be drilled, such as to maximize production, minimize costs or time, combinations thereof, or the like.

At block 510, the method 500 includes drilling a well into the hydrocarbon reservoir based on the trajectory. A drilling rig may be used to drill the hydrocarbon reservoir to facilitate the extraction of the hydrocarbons from the hydrocarbon reservoir.

Unlike conventional subsurface modeling software, the present techniques do not require a 3D grid for defining subsurface fluid distribution. This enables a user to use the same fluid distribution model on multiple simulations and geological 3D grids thereby reducing the risk of reporting different volumes from static modeling (volumetrics) versus dynamic simulation. This differentiation also makes the overall workflow much easier, faster and efficient.

Additional processes also may be included in the method 500. For example, the method 500 may include defining a plurality of fluid compartments within the fluid distribution model. In another example, the method 500 may include generating a three-dimensional mapping of the fluid distribution model. In yet another example, the method 500 may include comparing the fluid distribution model against reservoir performance data and updating the fluid distribution model based on the reservoir performance data. The method 500 may further include changing the drilling responsive to updating the fluid distribution model. Changing the drilling may include changing the drilling angle, the drilling depth, or other drilling parameters.

In some examples, the method 500 may include performing a simulation on the hydrocarbon reservoir using the fluid distribution model. The simulation enables an analyst to test various parameters relating to the hydrocarbon reservoir, such as fluid and rock parameters. As a result, the analyst can determine potential production rates/amounts from the hydrocarbon reservoir. In this way, hydrocarbon production can be maximized while operational costs and time can be reduced.

It should be understood that the processes depicted in FIG. 5 represent illustrations, and that other processes may be added or existing processes may be removed, modified, or rearranged without departing from the scope and spirit of the present disclosure.

Figure 6:
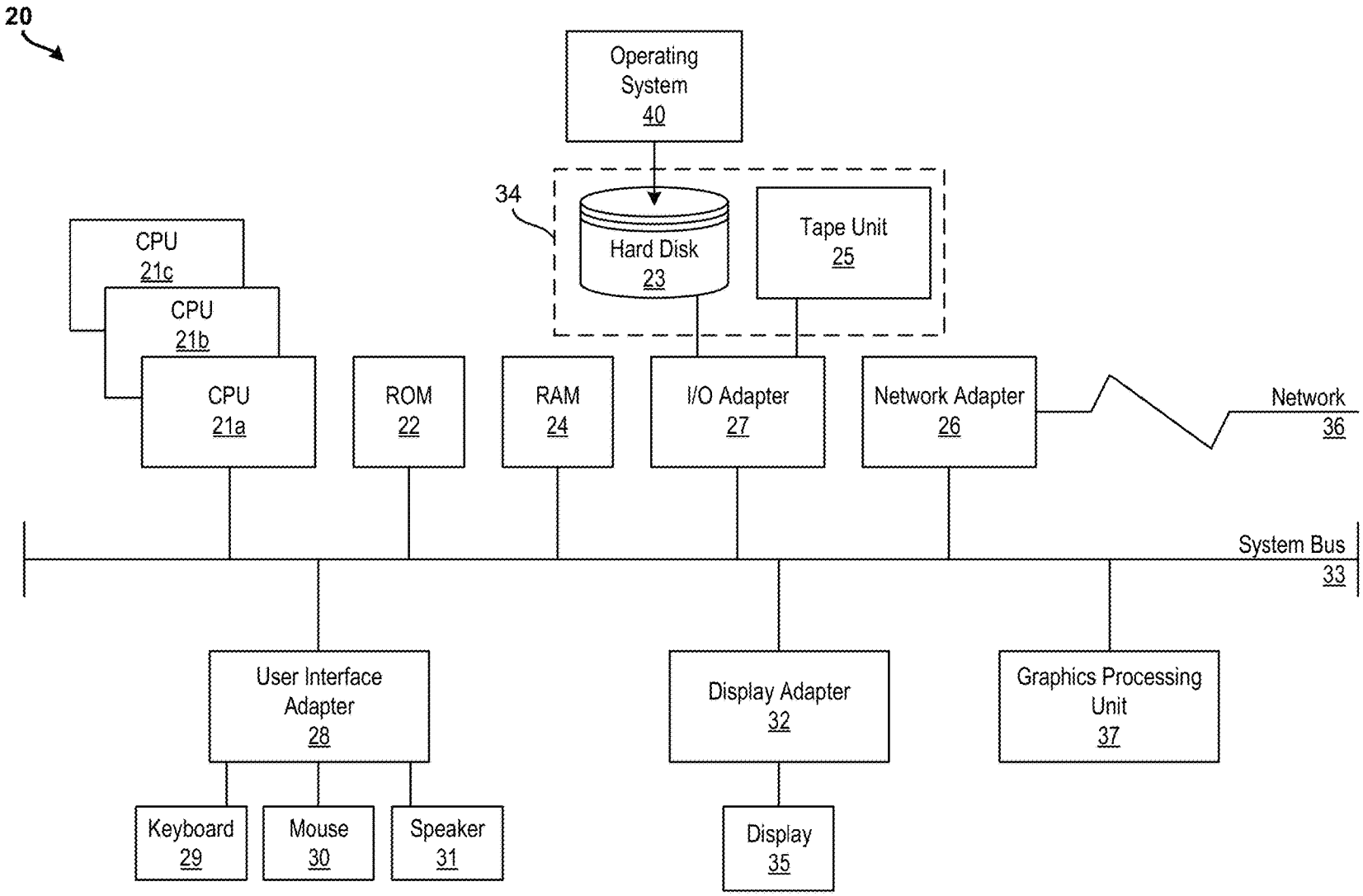
FIG. 6 illustrates a block diagram of a processing system for implementing the techniques described herein according to aspects of the present disclosure.

It is understood in advance that the present disclosure is capable of being implemented in conjunction with any other type of computing environment now known or later developed. For example, FIG. 6 illustrates a block diagram of a processing system 20 for implementing the techniques described herein. In examples, processing system 20 (also referred to as a processing device) has one or more central processing units (processors) 21*a*, 21*b*, 21*c*, etc. (collectively or generically referred to as processor(s) 21 and/or as processing device(s)). In aspects of the present disclosure, each processor 21 may include a reduced instruction set computer (RISC) microprocessor. Processors 21 are coupled to system memory (e.g., random access memory (RAM) 24) and various other components via a system bus 33. Read only memory (ROM) 22 is coupled to system bus 33 and may include a basic input/output system (BIOS), which controls certain basic functions of processing system 20.

Further illustrated are an input/output (I/O) adapter 27 and a communications adapter 26 coupled to system bus 33. I/O adapter 27 may be a small computer system interface (SCSI) adapter that communicates with a hard disk 23 and/or a tape storage drive 25 or any other similar component. I/O adapter 27, hard disk 23, and tape storage device 25 are collectively referred to herein as mass storage 34. Operating system 40 for execution on processing system 20 may be stored in mass storage 34. A network adapter 26 interconnects system bus 33 with an outside network 36 enabling processing system 20 to communicate with other such systems.

A display (e.g., a display monitor) 35 is connected to system bus 33 by display adaptor 32, which may include a graphics adapter to improve the performance of graphics intensive applications and a video controller. In one aspect of the present disclosure, adapters 26, 27, and/or 32 may be connected to one or more I/O busses that are connected to system bus 33 via an intermediate bus bridge (not shown). Suitable I/O buses for connecting peripheral devices such as hard disk controllers, network adapters, and graphics adapters typically include common protocols, such as the Peripheral Component Interconnect (PCI). Additional input/output devices are shown as connected to system bus 33 via user interface adapter 28 and display adapter 32. A keyboard 29, mouse 30, and speaker 31 may be interconnected to system bus 33 via user interface adapter 28, which may include, for example, a Super I/O chip integrating multiple device adapters into a single integrated circuit.

In some aspects of the present disclosure, processing system 20 includes a graphics processing unit 37. Graphics processing unit 37 is a specialized electronic circuit designed to manipulate and alter memory to accelerate the creation of images in a frame buffer intended for output to a display. In general, graphics processing unit 37 is very efficient at manipulating computer graphics and image processing, and has a highly parallel structure that makes it more effective than general-purpose CPUs for algorithms where processing of large blocks of data is done in parallel.

Thus, as configured herein, processing system 20 includes processing capability in the form of processors 21, storage capability including system memory (e.g., RAM 24), and mass storage 34, input means such as keyboard 29 and mouse 30, and output capability including speaker 31 and display 35. In some aspects of the present disclosure, a portion of system memory (e.g., RAM 24) and mass storage 34 collectively store an operating system to coordinate the functions of the various components shown in processing system 20.

The present techniques may be implemented as a system, a method, and/or a computer program product. The computer program product may include a computer readable storage medium (or media) having computer readable program instructions thereon for causing a processor to carry out aspects of the present disclosure.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present disclosure may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some examples, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present disclosure.

Aspects of the present disclosure are described herein with reference to flowchart illustrations and/or block diagrams of methods, apparatus (systems), and computer program products according to aspects of the present disclosure. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the figures illustrate the architecture, functionality, and operation of possible implementations of systems, methods, and computer program products according to various aspects of the present disclosure. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various examples of the present disclosure have been presented for purposes of illustration, but are not intended to be exhaustive or limited to the embodiments disclosed. Many modifications and variations will be apparent to those of ordinary skill in the art without departing from the scope and spirit of the described techniques. The terminology used herein was chosen to best explain the principles of the present techniques, the practical application or technical improvement over technologies found in the marketplace, or to enable others of ordinary skill in the art to understand the techniques disclosed herein.

Set forth below are some embodiments of the foregoing disclosure:

Embodiment 1

A computer-implemented method for integrated hydrocarbon fluid distribution modeling, the method comprising: generating, by a processing device, a structural model of a hydrocarbon reservoir; generating, by the processing device, a fluid distribution model based on the structural model and well data; responsive to receiving updated well data, updating, by the processing device, the fluid distribution model iteratively; determining, by the processing device, a trajectory to drill the hydrocarbon reservoir based on the fluid distribution model; and drilling a well into the hydrocarbon reservoir based on the trajectory.

Embodiment 2

The computer-implemented method of any previous embodiment, further comprising defining a plurality of fluid compartments within the fluid distribution model.

Embodiment 3

The computer-implemented method of any previous embodiment, further comprising generating, by the processing device, a three-dimensional mapping of the fluid distribution model.

Embodiment 4

The computer-implemented method of any previous embodiment, further comprising: comparing, by the processing device, the fluid distribution model against reservoir performance data; and updating, by the processing device, the fluid distribution model based on the reservoir performance data.

Embodiment 5

The computer-implemented method of any previous embodiment, further comprising, responsive to updating the fluid distribution model, changing the drilling.

Embodiment 6

The computer-implemented method of any previous embodiment, further comprising performing a simulation on the hydrocarbon reservoir using the fluid distribution model.

Embodiment 7

The computer-implemented method of any previous embodiment, wherein the well data is one of fluid logs, saturation logs, pressure data, and fluid properties.

Embodiment 8

The computer-implemented method of any previous embodiment, wherein the new well data is one of fluid logs, saturation logs, pressure data, and fluid properties.

Embodiment 9

A system for deployment risk management, the system comprising: a memory having computer-readable instructions; and a processing device for executing the computer readable instructions, the computer readable instructions comprising: generating a fluid distribution model based on a structural model and well data; responsive to receiving updated well data, updating the fluid distribution model iteratively; generating a three-dimensional mapping of the fluid distribution model; performing a simulation on the hydrocarbon reservoir using the fluid distribution model; drilling a well into the hydrocarbon reservoir based on the simulation.

Embodiment 10

The system of any previous embodiment, the computer-readable instructions further comprising defining a plurality of fluid compartments within the fluid distribution model.

Embodiment 11

The system of any previous embodiment, wherein the integrated hydrocarbon fluid distribution modeling.

Embodiment 12

The system of any previous embodiment, the computer-readable instructions further comprising: comparing the fluid distribution model against reservoir performance data; and updating the fluid distribution model based on the reservoir performance data.

Embodiment 13

The system of any previous embodiment, the computer-readable instructions further comprising, responsive to updating the fluid distribution model, changing the drilling.

Embodiment 14

The system of any previous embodiment, wherein changing the drilling comprises changing at least one of a drilling angle and a drilling depth.

Embodiment 15

The system of any previous embodiment, wherein the well data is one of fluid logs, saturation logs, pressure data, and fluid properties.

While one or more embodiments have been shown and described, modifications and substitutions may be made thereto without departing from the spirit and scope of the invention. Accordingly, it is to be understood that the present invention has been described by way of illustrations and not limitation.

What is claimed is:

1. A computer-implemented method for integrated hydrocarbon fluid distribution modeling, the method comprising:

generating, by a processing device, a three-dimensional (3D)-grid independent 3D geological structural model of a hydrocarbon reservoir;

generating, by the processing device, a 3D-grid independent 3D fluid distribution model comprising 3D fluid compartments based on the 3D-grid independent 3D structural model prior to drilling a well and prior to applying the 3D-grid independent 3D fluid distribution model to a 3D grid;

responsive to receiving well data, updating, by the processing device, the 3D fluid compartments and fluid levels of the 3D-grid independent 3D fluid distribution model iteratively based on the well data and prior to applying the 3D-grid independent 3D fluid distribution model to the 3D grid, wherein the well data is one or more of fluid logs, pressure data, saturation logs, and fluid properties;

subsequent to updating the 3D fluid compartments and fluid levels of the 3D-grid independent 3D fluid distribution model based on the well data, mapping the 3D-grid independent 3D fluid distribution model to the 3D grid to generate 3D grid properties, wherein the 3D grid properties are one or more of fluid compartments and rock properties;

determining, by the processing device, a trajectory to drill the hydrocarbon reservoir based on the 3D grid properties generated by the 3D-grid independent 3D fluid distribution model mapped on the 3D grid; and drilling a new well into the hydrocarbon reservoir based on the trajectory.

2. The computer-implemented method of claim 1, further comprising:

comparing, by the processing device, the 3D-grid independent 3D fluid distribution model against reservoir performance data; and updating, by the processing device, the fluid compartments and the fluid levels of the 3D-grid independent 3D fluid distribution model based on the reservoir performance data.

3. The computer-implemented method of claim 2, further comprising, responsive to updating the fluid compartments and the fluid levels of the 3D-grid independent 3D fluid distribution model, changing the trajectory.

4. The computer-implemented method of claim 1, further comprising performing a simulation on the hydrocarbon reservoir using the 3D grid properties.

5. A system for deployment risk management, the system comprising:

a memory having computer-readable instructions; and a processing device for executing the computer readable instructions performing a method for integrated hydrocarbon fluid distribution modeling, the method comprising:

generating a fluid distribution model three-dimensional (3D)-grid independent 3D based on a 3D-grid independent 3D geological structural model prior to drilling a well and prior to applying the 3D-grid independent 3D fluid distribution model to a 3D grid, wherein the 3D-grid independent 3D fluid distribution model comprises 3D fluid compartments;

responsive to receiving well data, updating the 3D fluid compartments and fluid levels of the 3D-grid independent 3D fluid distribution model iteratively based on the well data and prior to applying the 3D-grid independent 3D fluid distribution model to the 3D grid, wherein the well data is one or more of fluid logs, pressure data, saturation logs, and fluid properties;

subsequent to updating the 3D fluid compartments and fluid levels of the 3D-grid independent 3D fluid distribution model based on the well data, mapping the 3D-grid independent 3D fluid distribution model to the 3D grid to generate 3D grid properties, wherein the 3D grid properties are one or more of fluid compartments to generate 3D grid properties, wherein the 3D grid properties are one or more of fluid compartments and rock properties;

performing a simulation on the hydrocarbon reservoir using the 3D-grid independent 3D fluid distribution model; and drilling new well into the hydrocarbon reservoir based on the simulation.

6. The system of claim 5, the computer-readable instructions further comprising:

comparing the 3D-grid independent 3D fluid distribution model against reservoir performance data; and updating the fluid compartments and the fluid levels of the 3D-grid independent 3D fluid distribution model based on the reservoir performance data, the reservoir performance data comprising one or more of a pressure depletion rate and a hydrocarbon production rate.

7. The system of claim 6, the computer-readable instructions further comprising, responsive to updating the fluid compartments and the fluid levels of the 3D-grid independent 3D fluid distribution model, changing the trajectory.

8. The system of claim 7, wherein changing the trajectory comprises changing at least one of a drilling angle and a drilling depth.

9. The computer-implemented method of claim 1, further comprising:

subsequent to updating the 3D fluid compartments and fluid levels of the 3D-grid independent 3D fluid distribution model based on the well data, mapping the 3D-grid independent 3D fluid distribution model to a plurality of wells to generate well logs.

10. The computer-implemented method of claim 9, further comprising:

comparing the generated well logs to original well logs to update the 3D fluid compartments and fluid levels.

* * * * *